US009487986B2

(12) United States Patent
Okachi et al.

(10) Patent No.: US 9,487,986 B2
(45) Date of Patent: Nov. 8, 2016

(54) SLIDE GUIDE FRAME PORTION OF SCREEN DEVICE

(71) Applicant: Metaco Inc., Tokyo (JP)

(72) Inventors: Yasubumi Okachi, Kanagawa (JP); Mitsuharu Watanabe, Kanagawa (JP)

(73) Assignee: METACO INC., Tokyo (JP)

( * ) Notice: Subject to any disclaimer, the term of this patent is extended or adjusted under 35 U.S.C. 154(b) by 0 days.

(21) Appl. No.: 14/435,618

(22) PCT Filed: Oct. 17, 2013

(86) PCT No.: PCT/JP2013/078157

§ 371 (c)(1),
(2) Date: Apr. 14, 2015

(87) PCT Pub. No.: WO2014/069242

PCT Pub. Date: May 8, 2014

(65) Prior Publication Data

US 2015/0300067 A1 Oct. 22, 2015

(30) Foreign Application Priority Data

Nov. 5, 2012 (JP) ..... 2012-243837

(51) Int. Cl.
*A47H 1/00* (2006.01)
*E05D 15/06* (2006.01)
*E06B 9/54* (2006.01)

(52) U.S. Cl.
CPC ..... *E05D 15/0621* (2013.01); *E06B 9/54* (2013.01); *E06B 2009/543* (2013.01)

(58) Field of Classification Search
CPC E05D 15/0621; E06B 9/54; E06B 2009/543
See application file for complete search history.

(56) References Cited

U.S. PATENT DOCUMENTS 4,745,714 A * 5/1988 Matsutani ..... E04H 12/185 242/399
4,757,852 A 7/1988 Jentof et al.
(Continued)

FOREIGN PATENT DOCUMENTS

JP 61-78989 5/1986
JP 7-147711 6/1995
(Continued)

OTHER PUBLICATIONS

International Search Report issued Jan. 21, 2014 in International Application No. PCT/JP2013/078157.
(Continued)

*Primary Examiner* — Katherine Mitchell
*Assistant Examiner* — Abe Massad
(74) *Attorney, Agent, or Firm* — Wenderoth, Lind & Ponack, L.L.P.

(57) ABSTRACT

In a side wall portion of a rigid unit which forms a slide guide frame portion, a depressed portion is formed in one approximately half portion, a through hole is formed in the other approximately half portion, and a protrusion is provided adjacent to the through hole inside the substantially center portion. In the depressed portion, a shaft protruding toward the outside is provided in the substantially center portion, and a notch portion cut in a height direction of the rigid unit is formed from the substantially center portion of the depressed portion to one end portion of the side wall portion. Adjacent two rigid units are connected by a shaft which is inserted into the through hole from the inside, and one unit is freely rotated with respect to the other unit within a range in which the protrusion abuts on one end and the other end of the notch portion.

4 Claims, 3 Drawing Sheets

(56) References Cited

U.S. PATENT DOCUMENTS

| | | | | |
|---|---|---|---|---|
| 6,186,212 | B1 * | 2/2001 | Tsuchida | E06B 9/54 160/194 |
| 6,283,193 | B1 | 9/2001 | Finch et al. | |
| 6,644,378 | B2 | 11/2003 | Mitchell | |
| 6,814,127 | B2 | 11/2004 | Tagtow et al. | |
| 6,896,027 | B2 | 5/2005 | Crouch | |
| 7,717,152 | B2 | 5/2010 | Moriya et al. | |
| 7,810,543 | B2 * | 10/2010 | Donatelli | E06B 9/54 160/194 |
| 7,963,312 | B2 * | 6/2011 | Okachi | E06B 9/262 160/194 |
| 8,196,638 | B2 | 6/2012 | Roberts et al. | |
| 8,302,655 | B2 | 11/2012 | Lin | |
| 8,336,286 | B2 * | 12/2012 | Veltrop | B05C 17/0116 222/113 |
| 8,991,275 | B2 * | 3/2015 | Ishikawa | F16G 13/20 74/89.2 |
| 9,004,138 | B2 * | 4/2015 | Okachi | E06B 9/54 160/31 |
| 2008/0135189 | A1 | 6/2008 | Okachi et al. | |
| 2009/0008615 | A1 * | 1/2009 | Young | B66F 3/06 254/133 R |
| 2011/0132558 | A1 | 6/2011 | Okachi | |
| 2011/0240236 | A1 | 10/2011 | Savard et al. | |

FOREIGN PATENT DOCUMENTS

| | | | | |
|---|---|---|---|---|
| JP | 3323461 | | 6/2002 | |
| JP | 3403652 | | 5/2003 | |
| JP | 2005-23577 | | 1/2005 | |
| JP | 2005-351046 | | 12/2005 | |
| JP | WO 2011043436 | A1 * | 4/2011 | E06B 9/54 |
| WO | 2009/150911 | | 12/2009 | |

OTHER PUBLICATIONS

International Search Report (ISR) issued Nov. 2, 2010 in International (PCT) Application No. PCT/JP2010/0067683.

* cited by examiner (a)

(b)

SLIDE GUIDE FRAME PORTION OF SCREEN DEVICE

TECHNICAL FIELD

The present invention relates to a slide guide frame portion disposed in a versatile screen device which can be used as a curtain, a blind, a screen door, and a partition wall.

BACKGROUND ART

The present applicant proposes a screen device which performs smooth and stable opening/closing with reduced restrictions on installation when the screen device is used as a light blocking and light adjustment device such as a curtain a blind, a screen door, or a partition wall.

In the screen device disclosed in JP 3403652, a screen is attached to be freely developed between a pair of screen mounting frame portions which are disposed to face each other, and at least one of the screen mounting frame portions can slide. In addition, a pair of slide guide frame portions are disposed in the vicinity of both ends portions of the screen not on a side where the screen is attached to the screen mounting frame portion. These two slide guide frame portions have flexibility, with at least one end serving as a free end and capable of being stored in and drawn out of the slidable screen mounting frame portion. On the other hand, a portion of the slide guide frame portion drawn out of the screen mounting frame portion has linearity as the slidable screen mounting frame portion slides. With such a slide guide frame portion, restrictions on installation are removed, and smooth and stable opening/closing is realized.

The slide guide frame portion is formed by a plurality of rigid units in which adjacent two units are connected to each other. The rigid unit includes a pair of side wall portions disposed to face each other and a bridge portion linking both side wall portions. In the side wall portion, a protrusion protruding to the outside is disposed in one end portion in a length direction, and a through hole into which the protrusion can be inserted is formed in the other end portion. In addition, in the side wall portion, a small protrusion protruding toward the outside is disposed is adjacent to the protrusion and positioned on a side opposite to the through hole, and a long hole is formed which is adjacent to the through hole and formed in a substantially crescent shape on a side near the protrusion. The adjacent two rigid units are connected by inserting the protrusion into the through hole from inside of the side wall portion, and freely rotated by inserting the small protrusion into the long hole, and thus the slide guide frame portion is formed. Since the adjacent two rigid units are freely rotated, the slide guide frame portion has flexibility, the small protrusion abuts on one end in the length direction of the long hole, and rotation of the rigid unit is regulated, and thus linearity is secured.

The screen device in which the slide guide frame portion is disposed as described above releases restrictions on installation and realizes a smooth and stable opening/closing, so that the screen device can be used for general purposes. On the other hand, for example, there are requests to increase an opening area when the screen device is completely opened, and to improve ventilation when the screen device is completely closed in a case where the screen is formed by net or lace. These requests can be satisfied by reducing a width of the screen mounting frame portion (that is, a dimension in a width direction.

However, since the slidable screen mounting frame portion stores two slide guide frame portions therein, in order to reduce the width of the slidable screen mounting frame portion, the width of the slide guide frame portion is necessarily reduced. However, when the width of the slide guide frame portion is reduced, the slide guide frame portion formed of the present rigid units is degraded in strength for the connection between the rigid units. The dimension of the rigid unit in a height direction is necessarily reduced in order to realize the reduction of the width of the slide guide frame portion, but a long hole having the substantially crescent shape is formed in the side wall portion of the rigid unit, so that the strength of the side wall portion is insufficient. In addition, the long hole is necessarily made short for securing the strength of the side wall portion, but when the length of the long hole is made short, the size of the small protrusion becomes smaller, and thus it is not possible to secure a sufficient strength of the small protrusion.

SUMMARY OF THE INVENTION

The invention has been made in view of the above circumstances, and an object thereof is to provide a slide guide frame portion of a screen device which can reduce the width of the slidable screen mounting frame portion while at the same time securing a sufficient strength for the connection between rigid units.

In order to solve the above problems, a slide guide frame portion of a screen device of the invention includes a pair of hollow screen mounting frame portions configured to be disposed to face each other in which at least one of the portions is capable of sliding. A screen is configured to be attached between these screen mounting frame portions to be freely developed, and a slide guide frame portion configured to be disposed in the vicinity of either end portion of the screen not on a side where the screen is attached to the screen mounting frame portion. Each slide guide frame portion has flexibility, and at least one end serves as a free end and is capable of being stored in and drawn out of the slidable screen mounting frame portion. When the screen is drawn out of the screen mounting frame portion as the slidable screen mounting frame portion slides, a drawn-out portion of the slide guide frame portion has linearity. Any one or both of the two slide guide frame portions are formed by a plurality of rigid units, each of which includes a pair of side wall portions disposed to face each other, and a bridge portion linking both side wall portions from the substantially center portion to one end portion, in which adjacent two rigid units are rotatably connected to each other. In the side wall portion, a depressed portion which is depressed in a width direction of the rigid unit is formed in an approximately half portion from the substantially center portion to the one end portion. A through hole which is made in the width direction of the rigid unit is formed in the approximately half portion from the substantially center portion to the other end portion, and a protrusion is provided adjacent to the through hole inside the substantially center portion. In the depressed portion, a shaft protruding toward the outside is provided in the substantially center portion, and a notch portion which is cut in a height direction of the rigid unit is formed from the substantially center portion of the depressed portion to the one end portion of the side wall portion. The adjacent two rigid units are connected such that the shaft of one rigid unit is inserted into the through hole of the other rigid unit from the inside, and the one rigid unit is freely rotated with respect to the other rigid unit within a range in which the protrusion abuts on one end and the other end of the notch portion.

In the shaft of the slide frame unit of the screen device, a chamfer portion inclining toward the inside in the width direction of the rigid unit is preferably formed on a side near the one end portion of the side wall portion.

In addition, in the screen device of the slide guide frame portion of the screen device, one of the two screen mounting frame portions is fixed. A roller pipe having a built-in coil spring is rotatably stored inside the fixed screen mounting frame portion. One end of the screen is attached to the roller pipe. The roller pipe is rotated by an elastic force generated in the coil spring, and the screen is preferably wound around the outer peripheral of the roller pipe.

Advantageous Effects of Invention

According to a slide guide frame portion of a screen device of the invention, a reduced width of a slidable screen mounting frame portion can be realized while at the same time securing a connection strength sufficient for a rigid unit.

DESCRIPTION OF EMBODIMENTS

Figure 1:
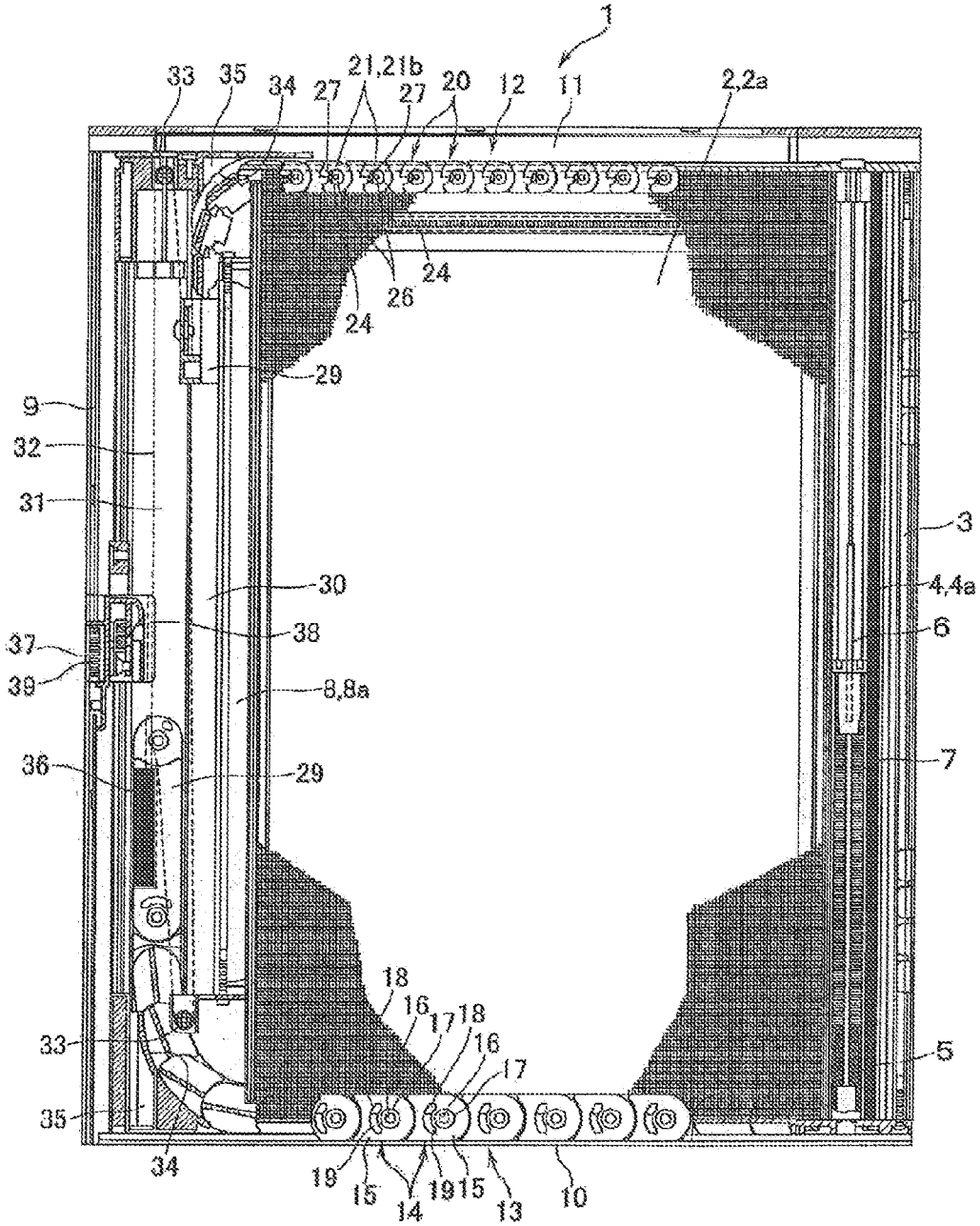
FIG. 1 is a partially-broken front view illustrating an embodiment of a slide guide frame portion of a screen device of the invention, the screen device including the slide guide frame portion.

FIG. 1 is a partially-broken front view illustrating an embodiment of a slide guide frame portion of a screen device of the invention, the screen device including the slide guide frame portion.

A screen device 1 includes a net 2*a* as a screen 2 which is opened or closed in a horizontal direction. The screen 2 is made of fabrics such as woven fabrics and knitted fabrics, and appropriately selected from those having a light blocking property or those used as insect screens according to necessary characteristics. In this embodiment, the net 2*a* applied as the insect screen is employed. In addition, the shape of the screen 2 including the net 2*a* is not particularly limited, and can be pleated as needed.

On the right side of the screen device 1, a hollow screen mounting frame portion 3 is disposed. The screen mounting frame portion 3, for example, is fixed to a right frame which is extended in the longitudinal direction of a rectangular opening in a building. In the screen mounting frame portion 3, a roller pipe 4 is built in and contained therein. One end of the screen 2 is attached to the roller pipe 4.

The roller pipe 4 includes a hollow main body 4*a* having a substantially cylindrical shape and a bearing 5 connected to the lower end of the main body 4*a*. A rotation shaft 6 is provided inside the main body 4*a*. The rotation shaft 6 is extended on the way to the roller pipe 4 in a height direction from the bearing 5. In addition, a coil spring 7 is built in the main body 4*a*, and the coil spring 7 is provided about the rotation shaft 6. In the coil spring 7, an elastic force generated when being twisted is accumulated, and when the accumulated elastic force is released, the main body 4*a* is automatically rotated about the rotation shaft 6. At this time, the screen 2 of which the one end is attached to the roller pipe 4 is wound around the outer peripheral of the main body 4*a*. On the other hand, when the wound screen 2 is drawn out in a direction to close the screen device 1, the main body 4*a* of the roller pipe 4 is rotated in a direction opposite to the above direction, and the coil spring 7 is twisted while accumulating the elastic force.

The other end of the screen 2 is attached to a screen mounting frame portion 8 which can slide with respect to the fixed screen mounting frame portion 3 in the horizontal direction to open and close the screen 2. The screen mounting frame portion 8 includes a hollow main body 8*a* which is formed in a rectangular cylindrical shape having a rectangular cross portion, and the main body 8*a* is extended in the longitudinal direction of the screen device 1. The slidable screen mounting frame portion 8, for example, slides in the horizontal direction between the screen mounting frame portion 3 and a door stop frame 9 which is attached to the left frame and extends in the longitudinal direction of the opening of the building. The screen 2 is configured to be opened or closed by such a sliding of the screen mounting frame portion 8.

In addition, for example, in the screen device 1, as a guide of the screen mounting frame portion 8, a lower rail 10 is provided in a floor surface or the like in order to realize a smooth sliding of the screen mounting frame portion 8, and an upper rail 11 is provided in the upper frame which is extended in the horizontal direction of the opening of the building. The lower rail 10, for example, may be formed in an elongate rod shape. The upper rail 11, for example, may be formed as a frame having a U shape in cross-portional view. In this case, the upper rail 11 can cover and hide the upper end portions of the screen mounting frame portions 3 and 8 and the screen 2 from both front and back sides of the screen device 1, and contributes to an improvement in visual quality of the screen device 1.

When the screen 2 is opened and closed, an operator takes the screen mounting frame portion 8 in his/her hand and can make the screen mounting frame portion 8 slide in the horizontal direction. At this time, the screen mounting frame portion 8 is guided from the inside by the lower rail 10 and guided from the outside by the upper rail 11 so as to smoothly slide in the opening of the building in the horizontal direction. In the screen mounting frame portion 8, a handle may be provided in the front surface and even in the back surface as needed, so that the operator can easily open/close the screen.

In addition, in the screen device 1, an upper slide guide frame portion 12 is provided in the vicinity of the upper end of the screen 2, and a lower slide guide frame portion 13 is provided in the vicinity of the lower end of the screen 2. The upper slide guide frame portion 12 and the lower slide guide frame portion 13 both serve to dispose the slidable screen mounting frame portion 8 in parallel to the screen mounting frame portion 3, and stably keep such a parallel positional relationship even when the screen mounting frame portion 8 slides. The opening/closing of the screen 2 is securely performed by the upper slide guide frame portion 12 and the lower slide guide frame portion 13.

In the screen device 1, the present slide guide frame portion is employed to the lower slide guide frame portion 13, and a new slide guide frame portion is employed to the upper slide guide frame portion 12.

In other words, the lower slide guide frame portion 13 is formed by a plurality of first rigid units 14 as the present rigid units in which adjacent two rigid units are rotatably connected. The first rigid unit 14 includes a pair of side wall portions 15 which are disposed to face each other, and a bridge portion (not illustrated) which links both side wall portions 15 at a position near the upper end portion of the side wall portion 15 and in a left end portion from the substantially center portion. In the side wall portion 15, a protrusion 16 which protrudes to the side is disposed in the left end portion, and a through hole 17 where the protrusion 16 is inserted into and passes through in a width direction of the first rigid unit 14 is formed in the right end portion. The plurality of first rigid units 14 is connected by inserting the protrusions 16 of the adjacent two units into the through holes 17 from the back surface of the side wall portion 15, and forms the lower slide guide frame portion 13. In this way, since the first rigid units 14 are connected by inserting the protrusions 16 into the through holes 17, the first rigid units 14 are configured such that the adjacent two units are rotatably connected to each other. Since the first rigid units 14 are rotatably provided, the lower slide guide frame portion 13 is realized to have flexibility.

In addition, in the first rigid unit 14, a small protrusion 18 which protrudes to the outside from the side wall portion 15 is disposed on the left side of the protrusion 16. In addition, a long hole 19 of the substantially crescent shape is formed on the left side of the through hole 17 to pass through the side wall portion 15 in the width direction of the first rigid unit 14. The long hole 19 can accept the small protrusion 18, and when the first rigid units 14 are connected, the small protrusion 18 is inserted into the long hole 19. In this way, since the small protrusion 18 is inserted into the long hole 19, when the small protrusion 18 abuts on one end of the long hole 19 in the adjacent two first rigid units 14, the rotation of the first rigid unit 14 is stopped. Therefore, the lower slide guide frame portion 13 can have linearity.

In the upper slide guide frame portion 12, a plurality of second rigid units 20 as new rigid units is formed such that the adjacent two units are rotatably connected.

Figure 2:
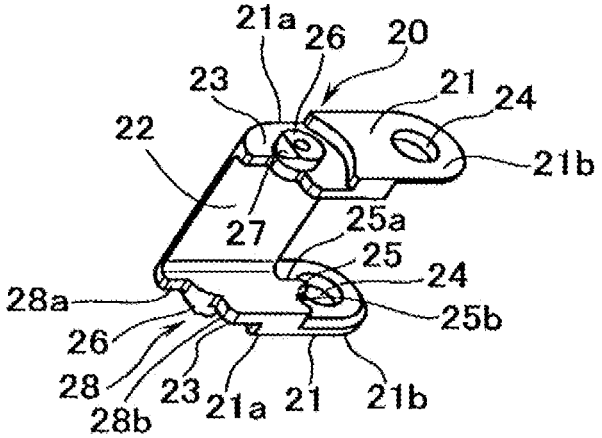
FIGS. 2(*b*) and 2(*a*) are perspective views illustrating a rigid unit forming the slide guide frame portion illustrated in FIG. 1, and a part of the slide guide frame portion, respectively.
Figure 2:
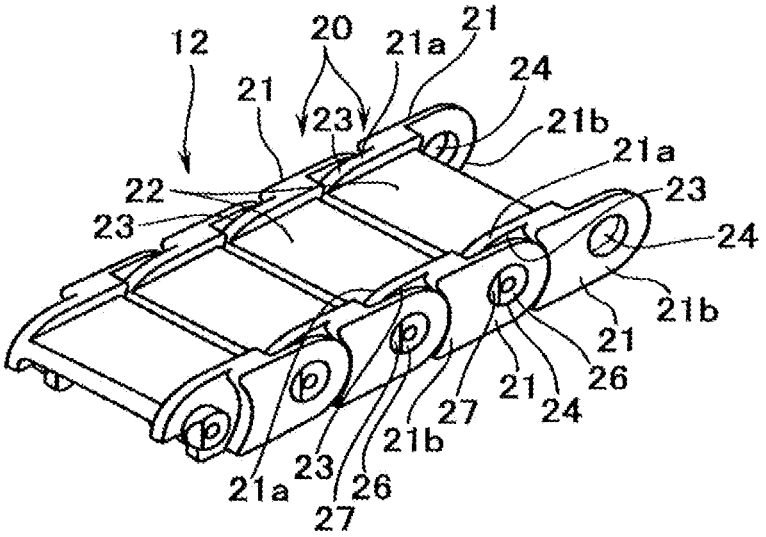

FIGS. 2(*b*) and 2(*a*) are perspective views illustrating the rigid unit forming the slide guide frame portion illustrated in FIG. 1 and a part of the slide guide frame portion, respectively. In addition, FIGS. 3(*a*), 3(*b*), 3(*c*), 3(*d*), and 3(*e*) are a front view, a top view, a bottom view, a left side view, and a right side view of the rigid unit illustrated in FIG. 2(*a*).

The upper slide guide frame portion 12 is formed by the plurality of second rigid units 20, each of which includes a pair of side wall portions 21 disposed to face each other on the right and left sides and a bridge portion 22 linking both side wall portions 21 from the substantially center portion to one end portion on the left side. The adjacent two second rigid units are rotatably connected. The side wall portions 21 and the bridge portion 22 of the rigid unit 20 are members having the substantially flat shape.

Figure 3:
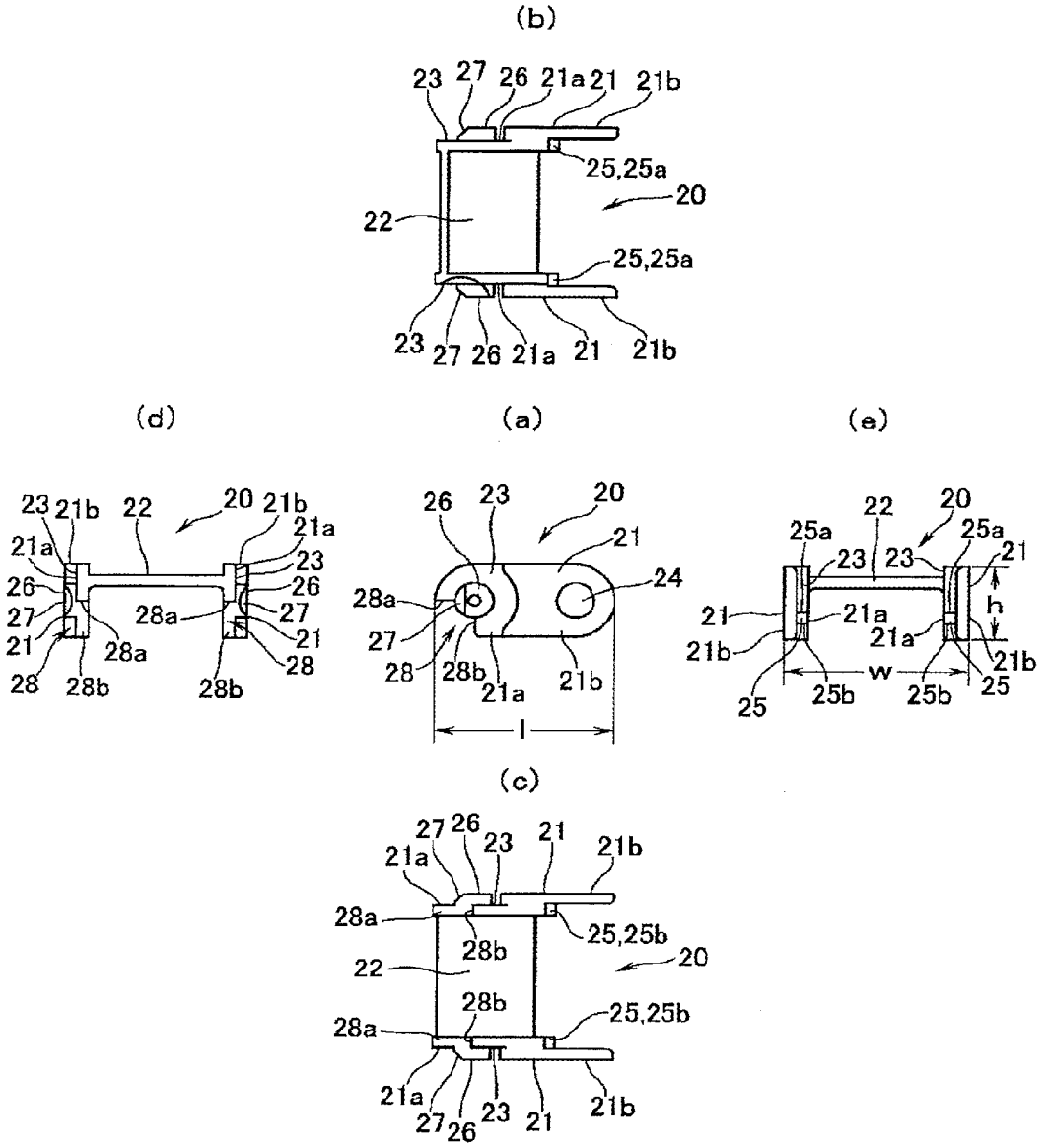
FIGS. 3(*a*), 3(*b*), 3(*c*), 3(*d*), and 3(*e*) are a front view, a top view, a bottom view, a left side view, and a right side view of the rigid unit illustrated in FIG. 2(*a*), respectively.

In the side wall portion 21, a depressed portion 23 which is depressed in a width direction w (see FIG. 3(*e*)) of the second rigid unit 20 is formed in an approximately half portion 21*a* formed from the substantially center portion to the one end portion on the left side. The left end and the right end of the depressed portion 23 both are formed in an arc shape in front view. In addition, in the side wall portion 21, a through hole 24 which passes through in the width direction w of the second rigid unit 20 is formed in an approximately half portion 21*b* formed from the substantially center portion to the other end portion on the right side. One end on the right side of the approximately half portion 21*b* is formed in a semicircular shape in front view. In addition, in the side wall portion 21, a protrusion 25 is provided adjacent to the through hole 24 inwardly to the substantially center portion. As illustrated in FIG. 2(*a*), in the protrusion 25, an upper surface 25*a* is a flat surface extending in parallel to a length direction 1 (see FIG. 3(*a*)) of the second rigid unit 20, and a lower surface 25*b* is an inclined surface which is inclined with respect to the upper surface 25*a*. An inclined degree of the lower surface 25*b* with respect to the upper surface 25*a*, for example, may be set to about 30°.

In the depressed portion 23, a shaft 26 is provided in the substantially center portion to protrude toward the outside. In the shaft 26, a chamfer portion 27 inclined toward the inside in the width direction w of the second rigid unit 20 is formed in the one end portion on the left side of the side wall portion 21. In addition, in the depressed portion 23, a notch portion 28 cut in a height direction h (see FIG. 3(*e*)) of the second rigid unit 20 is formed from the substantially center portion to the one end portion on the left side of the side wall portion 21. The notch portion 28 is formed by cutting the approximately half portion 21*a* from the lower surface to the half of the height of the approximately half portion 21*a* into an arc shape, and includes one end 28*a* in parallel with the length direction 1 of the second rigid unit 20 and the other end 28*b* in parallel with the height direction h of the second rigid unit 20.

The adjacent two second rigid units 20 are connected such that the shaft 26 of one second rigid unit 20 is inserted into the through hole 24 of the other second rigid unit 20 from the inside. Since the chamfer portion 27 is formed in the shaft 26, the shaft 26 is easily inserted into the through hole 24, and thus the connection between the second rigid units 20 is easily realized. In the adjacent two second rigid units 20 thus connected, one second rigid unit 20 is freely rotated with respect to the other second rigid unit 20 within a range (about 60°) in which the upper surface 25*a* of the protrusion 25 abuts on one end 28*a* and the other end 28*b* of the notch portion 28. Therefore, the upper slide guide frame portion 12 formed by the plurality of second rigid units 20 in which the adjacent two units are rotatably connected has the flexibility. In addition, when the upper surface 25*a* of the protrusion 25 provided in the side wall portion 21 of the second rigid unit 20 abuts on one end 28*a* of the notch portion 28 formed in the depressed portion 23 of the side wall portion 21, the upper slide guide frame portion 12 has the linearity.

Therefore, in the upper slide guide frame portion 12 formed by the plurality of second rigid units 20 as the new rigid units, the width is reduced compared to the lower slide guide frame portion 13 formed by the first rigid units 14 as the present rigid units as illustrated in FIG. 1. In other words, the second rigid unit 20 is reduced in dimension in the height direction h. Since a rotation limit of the second rigid unit 20 is determined by the protrusion 25 and the notch portion 28, the small protrusion 18 and the long hole 19 required for the first rigid unit 14 are eliminated. With the elimination of the long hole 19, the strength of the side wall portion 21 can be secured, and furthermore there is no need to take the strength of the small protrusion 18 into consideration. The connection strength made by the shaft 26 is sufficiently high, and the connection strength of the second rigid unit 20 in the upper slide guide frame portion 12 is sufficiently secured.

The second rigid units 20 forming the upper slide guide frame portion 12 may be formed of a material having a good moldability such as resin or metal similarly to the present first rigid unit 14. In a case where the second rigid unit 20 is formed of the resin or the metal, the approximately half portion 21*b* of the side wall portion 21 can be expanded to the outside due to elasticity, and furthermore can be spontaneously restored to the original state. Therefore, the connection between the second rigid units 20 becomes easier.

In the screen device 1 illustrated in FIG. 1, the upper slide guide frame portion 12 can be bent downward, and the lower slide guide frame portion 13 can be bent upward. In addition, the right ends of the upper slide guide frame portion 12 and the lower slide guide frame portion 13 both are configured by fixed ends, and fixed to the screen mounting frame portion 3. On the other hand, the left end serves as a free end 29 and disposed in the main body 8*a* of the screen mounting frame portion 8, and the upper slide guide frame portion 12 and the lower slide guide frame portion 13 can be stored in and drawn out of the inside of the main body 8*a* of the screen mounting frame portion 8. The inside of the main body 8*a* of the screen mounting frame portion 8 is partitioned into two portions: a first storage portion 30 in which the upper slide guide frame portion 12 is stored; and a second storage portion 31 in which the lower slide guide frame portion 13 is stored. For example, the first storage portion 30 and the second storage portion 31 can be partitioned in the main body 8*a* by providing a rib or the like protruding into the main body 8*a* in the height direction of the main body 8*a*. The first storage portion 30 is disposed on a side near the mounting portion of the screen 2 in the screen mounting frame portion 8, and the second storage portion 31 is disposed on a side away from the mounting portion of the screen 2. Therefore, when the upper slide guide frame portion 12 and the lower slide guide frame portion 13 are stored in the main body 8*a* of the screen mounting frame portion 8, each free end 29 does not abut. The upper slide guide frame portion 12 and the lower slide guide frame portion 13 both are smoothly stored in the main body 8*a* of the screen mounting frame portion 8. In addition, when being drawn out of the inside of the main body 8*a*, the upper slide guide frame portion 12 and the lower slide guide frame portion 13 do not interfere with each other.

In each free end 29, the upper slide guide frame portion 12 and the lower slide guide frame portion 13 are connected to each other by a tensile member 32 appropriately selected from a wire material such as a cord or a wire. Since the upper slide guide frame portion 12 and the lower slide guide frame portion 13 are connected by the tensile member 32, the amount of movement inside and outside the main body 8*a* becomes substantially equal according to the sliding of the screen mounting frame portion 8. Therefore, the slidable screen mounting frame portion 8 securely moves in parallel with respect to the fixed screen mounting frame portion 3. The tensile member 32 is looped inside the main body 8*a* of the screen mounting frame portion 8, wound around a direction changing member 33 provided on both upper and lower sides of the screen mounting frame portion 8, and folded back. The direction changing member 33 may be configured as a pulley of a barrel shape having a curved surface on which the tensile member 32 can be surrounded.

In addition, inside the main body 8*a* of the screen mounting frame portion 8, a guide block 35 is provided in both upper and lower end portions where the upper slide guide frame portion 12 and the lower slide guide frame portion 13 move forward and backward. The guide block 35 includes a guide surface 34 therein to guide the bending of the upper slide guide frame portion 12 and the lower slide guide frame portion 13. In the guide block 35 on the upper side, the guide surface 34 is concavely bent from the right end to the lower end. In the guide block 35 on the lower side, the guide surface 34 is concavely bent from the right end to the upper end. In addition, in the guide block 35 on the lower side, the direction changing member 33 which folds back the tensile member 32 is attached. On the other hand, the direction changing member 33 on the upper side is disposed adjacent to the left side of the guide block 35 on the upper side.

The upper slide guide frame portion 12 and the lower slide guide frame portion 13 are stored inside the main body 8*a* of the screen mounting frame portion 8 according to the sliding of the slidable screen mounting frame portion 8 in the horizontal direction, and drawn out therefrom. A portion drawn out of the screen mounting frame portion 8 has the linearity by the first rigid unit 14 and the second rigid unit 20 as described above.

Further, when the lower slide guide frame portion 13 is stored from the lower side of the screen mounting frame portion 8 into the main body 8*a*, a storage direction becomes opposite to a direction of gravity, so that a spindle 36 is provided in the free end 29. The weight of the spindle 36 is applied from the lower portion of the lower slide guide frame portion 13 to a rising portion, and when the lower slide guide frame portion 13 is drawn out of the screen mounting frame portion 8, the lower slide guide frame portion 13 is appropriately pushed out. In addition, when the lower slide guide frame portion 13 is stored inside the main body 8*a* of the screen mounting frame portion 8, the approach of the lower slide guide frame portion 13 is appropriately suppressed. Therefore, it is realized that the lower slide guide frame portion 13 is smoothly and stably stored in and drawn out of the main body 8*a* of the screen mounting frame portion 8.

In addition, in the screen device 1, a latch 37 is disposed in the door stop frame 9. The latch 37 includes an engaging portion 38 which protrudes toward the screen mounting frame portion 8 and is bent downward. In addition, the latch 37 is applied with an elastic force of an installed spring 39, and can move upward and downward. In a facing surface portion of the screen mounting frame portion 8 facing the latch 37, a hanger (not illustrated) having an opening (not illustrated) which is engaged with the engaging portion 38 is provided.

In a case where the screen mounting frame portion 8 slides up to the door stop frame 9 when the screen 2 is closed, the engaging portion 38 of the latch 37 is inserted into the opening of the hanger, and the end is hung on the edge of the opening and engaged with the hanger. Through the engagement, the screen mounting frame portion 8 is stopped in its movement against the elastic force of the coil spring 7 built in the roller pipe 4, and the screen device 1 can be stably kept in a closed state.

In the screen device 1 as described above, the new slide guide frame portion having a reduced width is employed to the upper slide guide frame portion 12. Therefore, even when the present slide guide frame portion is employed to the lower slide guide frame portion 13, it is possible to reduce the width of the slidable screen mounting frame portion 8 where the upper slide guide frame portion 12 and the lower slide guide frame portion 13 are stored. Therefore, it is simply realized that an opening area is increased when the screen device 1 is completely opened. Further, in a case where the screen 2 is formed by net or lace, improved ventilation is simply realized when the screen device 1 is completely closed.

Hitherto, the description has been made according to the embodiments of the invention, but the invention is not limited to the embodiments. The details on the shape and the size of the rigid unit forming the new slide guide frame portion may be variously modified. In addition, the new slide guide frame portion can be similarly employed not only to the upper slide guide frame portion but also to the lower slide guide frame portion. In addition, the invention is not limited to a method of storing the screen into the roller pipe, and for example, it is possible to employ the screen which is pleated, contracted and stored between a pair of screen mounting frame portions.

REFERENCE SIGNS LIST

1 Screen device
2 Screen
3 Fixed screen mounting frame portion
4 Roller pipe
7 Coil spring
8 Slidable screen mounting frame portion
12 Upper slide guide frame portion
13 Lower slide guide frame portion
20 Second rigid unit (new)
21 Side wall portion
21*a* Approximately half portion
21*b* Approximately half portion
22 Bridge portion
23 Depressed portion
24 Through hole
25 Protrusion
26 Shaft
27 Chamfer portion
28 Notch portion
28*a* One end
28*b* Other end According to a slide guide frame portion of a screen device of the invention, a slidable screen mounting frame portion with reduced width is realized while securing connection strength sufficient for a rigid unit.

The invention claimed is:

1. A sliding screen device comprising:

a pair of hollow screen mounting frame portions configured to be disposed to face each other in which at least one of the pair of screen mounting frame portions is capable of sliding;

a screen configured to be attached between the pair of hollow screen mounting frame portions to be freely developed; and a slide guide frame portion configured to be disposed in a vicinity of either end portion of the screen other than opposite ends where the screen is attached to the pair of hollow screen mounting frame portions, wherein the slide guide frame portion has flexibility, at least one end of the slide guide frame portion serving as a free end and is capable of being stored in and drawn out of the slidable one of the pair of screen mounting frame portions, and when the slide guide frame portion is drawn out of the slidable one of the pair of screen mounting frame portions as the slidable one of the pair of screen mounting frame portion slides, a drawn-out portion of the slide guide frame portion has linearity, wherein the slide guide frame portion comprises a plurality of rigid units, each of the plurality of rigid units including a pair of side wall portions disposed to face each other and a bridge portion linking both of the pair of side wall portions from a substantially center portion of the pair of side wall portions to one end portion of the pair of side wall portions, in which adjacent ones of the plurality of rigid units are rotatably connected to each other, wherein the side wall portion comprises a depressed portion which is depressed in a width direction of the respective one of the plurality of rigid units is formed in an approximately half portion from the substantially center portion to the one end portion, a through hole which is made in the width direction of the respective one of the plurality of rigid units formed in the approximately half portion from the substantially center portion to the other end portion, and a protrusion provided adjacent to the through hole inside the substantially center portion, wherein the depressed portion comprises a shaft protruding toward an outside direction provided in the substantially center portion, and a notch portion in a height direction of the respective one of the plurality of rigid units formed from the substantially center portion of the depressed portion to the one end portion of the side wall portion, and wherein the plurality of rigid units are connected such that the shaft of one of the plurality of rigid units is inserted into the through hole of an adjacent one of the plurality of rigid units from an inside position, and the adjacent one of the plurality of rigid units is freely rotated with respect to the one of the plurality of rigid units within a restricted range of rotational motion in which the protrusion abuts against on one end and the other end of the notch portion.

2. The sliding screen device according to claim 1, wherein the shaft comprises a chamfer portion inclining toward the inside in the width direction of the respective one of the plurality of rigid units is formed on a side near the one end portion of the side wall portion.

3. The sliding screen device according to claim 1, wherein one of the pair of hollow screen mounting frame portions is fixed, the fixed one of the pair of hollow screen mounting frame portions including a roller pipe having a built-in coil spring rotatably stored inside the fixed one of the pair of hollow screen mounting frame portions, wherein one end of the screen is attached to the roller pipe, the roller pipe is rotated by an elastic force generated in the built-in coil spring, and the screen is wound around an outer peripheral of the roller pipe.

4. The sliding screen device according to claim 2, wherein one of the pair of hollow screen mounting frame portions is fixed, the fixed one of the pair of hollow screen mounting frame portions including a roller pipe having a built-in coil spring rotatably stored inside the fixed one of the pair of hollow screen mounting frame portions, wherein one end of the screen is attached to the roller pipe, the roller pipe is rotated by an elastic force generated in the built-in coil spring, and the screen is wound around an outer peripheral of the roller pipe.

* * * * *